US006813025B2

(12) United States Patent
Edwards

(10) Patent No.: US 6,813,025 B2
(45) Date of Patent: Nov. 2, 2004

(54) MODULAR SCOPE

(76) Inventor: Ralph C. Edwards, 3124 NE. 16th Ave., Portland, OR (US) 97212

( * ) Notice: Subject to any disclaimer, the term of this patent is extended or adjusted under 35 U.S.C. 154(b) by 0 days.

(21) Appl. No.: 10/155,802

(22) Filed: May 24, 2002

(65) Prior Publication Data

US 2002/0191282 A1 Dec. 19, 2002

Related U.S. Application Data

(60) Provisional application No. 60/299,549, filed on Jun. 19, 2001.

(51) Int. Cl.[7] ..... G02B 23/00; F41G 1/38

(52) U.S. Cl. ..... 356/422; 359/399; 42/122

(58) Field of Search ..... 359/399–430, 359/800–819; 42/100–132; 396/429–433

(56) References Cited

U.S. PATENT DOCUMENTS 3,506,330 A * 4/1970 Allen ..... 356/397
3,709,124 A * 1/1973 Hunt ..... 396/426
4,777,352 A * 10/1988 Moore ..... 235/404
5,400,267 A 3/1995 Denen et al. ..... 364/552
5,661,598 A * 8/1997 Tomioka ..... 359/388
5,669,174 A * 9/1997 Teetzel ..... 42/115
5,673,143 A 9/1997 Chin et al. ..... 359/354
6,020,996 A 2/2000 Perkins et al. ..... 359/399
6,192,614 B1 2/2001 Cliburn ..... 42/106
6,208,461 B1 3/2001 Gaber ..... 359/399
6,269,581 B1 * 8/2001 Groh ..... 42/122
6,519,083 B2 * 2/2003 Heinrich ..... 359/422

* cited by examiner

*Primary Examiner*—Thong Q Nguyen
(74) *Attorney, Agent, or Firm*—Kolisch Hartwell, P.C.

(57) ABSTRACT

The present invention provides a viewing scope adapted to be mounted on a device, such as a rifle or camera. The viewing scope may include a body module, an objective module, a test module, and a control module. The test module may be configured to test the performance of the scope. The control module may include a series of user inputs that can be accessed and activated by a user without requiring the user to move his or her visual focus from the scope.

12 Claims, 5 Drawing Sheets

MODULAR SCOPE

CROSS REFERENCE TO RELATED APPLICATIONS

The present application claims priority from U.S. Provisional Patent Application Ser. No. 60/299,549, filed Jun. 19, 2001, which is hereby incorporated by reference in its entirety for all purposes.

BACKGROUND OF THE INVENTION

Sporting and hunting enthusiasts have long used scopes to better enable visualization of wildlife. For example, hunters often attach riflescopes to their firearms to aid both in prey identification and shot accuracy. Moreover, wildlife photographers and enthusiasts typically attach scopes to both still and video cameras when taking pictures of wildlife.

Conventional scopes have been relatively unchanged for more than 30 years since the introduction and widespread use of variable power and nitrogen filling. The major exception is the introduction of illuminated reticles, or cross hairs, in the late 1990s, which enabled scopes to be used during low-light periods such as dawn and dusk.

The simplest scopes are fixed power and include objective and eyepiece lenses positioned at the ends of a body tube. The scope may include an erector assembly, which may include erector lenses mounted in a separate tube assembly, which is itself suspended inside the body tube. The erector assembly may be pivoted at one end by external adjustment screws to provide windage (i.e. horizontal) and elevation (i.e. vertical) movement of the point of aim.

Variable power riflescopes are more complex. The erector optics move along the optical axis of the scope to give an image of varying magnification. Generally, the user turns a ring external to the scope body to alter the relative size of the image in the scope. A typical zooming riflescope will create 3× (three times life-size) to 9× (nine times life-size) images, while a photographic scope may produce images in a much broader range of magnifications.

Riflescopes are typically mounted on firearms so a precise relationship is established between the bore of the rifle barrel and the shooter's line of sight through the riflescope. The goal is generally to have the point of aim for the scope match the point of impact for a particular type of ammunition at a known distance from the shooter. A scope may be "zeroed" during practice shooting to attempt to limit adjustments during actual shooting to accommodate for changes in distance and wind.

Hunters typically make many changes to the various settings of their scope during a day of hunting. For example, they may scan an area at low power (for example 3× magnification) to find an object of interest, and then zoom to a higher power (for example 9× magnification) when a potential target is spotted. In addition, those hunters who typically shoot small animals at long distances, often referred to as varmint hunters, make frequent changes to the elevation adjustment of their scopes during a single hunting session. Moreover, in situations when the distance to targets changes greatly, the shooter and rifle must be able to adapt to new conditions quickly and with a minimum of distraction.

This need may be even greater in military or law enforcement situations where the shooter must be aware of far more than simply the location of the target. For example, law enforcement SWAT team officers are always very conscious of their environment as well as the precise set up of their equipment. Adjustment to their scopes must be made with minimum distraction from their key duties.

Previous scopes have been described that allow users to zoom scopes with a minimum of distraction from the hunting or picture taking situation. See e.g. U.S. Pat. Nos. 6,252,706, 5,930,934, and 5,388,005, each of which is hereby incorporated by reference in its entirety for all purposes. In addition, scopes have been described that allow users to control adjustment of reticle brightness and night vision images. See e.g. U.S. Pat. Nos. 6,131,294, 5,937,562, 5,892,617, 5,375,072, 5,339,720, and 4,531,052, each of which is hereby incorporated by reference in its entirety for all purposes. Moreover, astronomical scopes have been described that allow for tracking of celestial bodies. See e.g. U.S. Pat. No. 6,304,376, which is hereby incorporated by reference in its entirety for all purposes. However, none of the previously described scopes allow the user to adjust the scope's magnification, focus, reticle brightness, windage and elevation without leaving the firing position. Thus, a scope that enables the user to make adjustments along the full range of standard riflescope adjustments without having to leave the firing position would be greatly desired.

Furthermore, traditional scope body designs include screws, levers, rings, or switches that penetrate the walls of the scope body. This can lead to fogging caused by the introduction of water or other fluids into the scope body. Because fogging of the lens can dramatically hinder the user's ability to see through the scope, a scope that prevents fogging would be greatly desired.

Most scopes are very limited in the degree to which they can be upgraded or changed to adapt to different conditions or new technologies. Thus, users are often forced to carry multiple optical devices, such as a scope plus binoculars, in anticipation of different conditions. For example, hunters may carry binoculars to scan an area to find an object of interest and then switch to a rifle and scope to shoot the targeted object.

Moreover, users who wish to own scopes having the latest capabilities are forced to purchase new scopes each time a new technology becomes available. Because both of these scenarios create inconvenience and increased expense for the user, it would be desirable to have a single scope that can be adapted to different conditions or upgraded to be compatible with new technology.

SUMMARY OF THE INVENTION

In a first embodiment, the present invention provides a modular viewing scope configured to be attached to a device. The modular viewing scope may include a plurality of modular units wherein one or more of the units are selected from the group consisting of: a body module, an objective module, an eyepiece module, a control module, and a test module. Moreover, each of the modular units may be adapted to be replaced and/or upgraded as desired by a user without requiring removal of the viewing scope from the device.

In another embodiment, the present invention provides an adjustable viewing scope adapted to be mounted on a device. The adjustable viewing scope may include a body module including a plurality of adjustment motors adapted to adjust the scope's magnification, focus, windage and elevation; an objective module adapted to provide a visual display; and a control module in electronic communication with the body and objective modules. The control module may be mounted on the body, and include a series of user inputs that can be accessed and activated by a user without requiring the user to move his visual focus from the scope. The inputs may be in electronic communication with the plurality of adjustment motors.

The advantages of the present invention will be understood more readily after consideration of the drawings and the Detailed Description.

DETAILED DESCRIPTION AND BEST MODE OF THE INVENTION

In one embodiment, the present invention provides a modular scope that is completely sealed with all adjustments, displays and other features controlled electronically via a separate, computerized control module.

Figure 1:
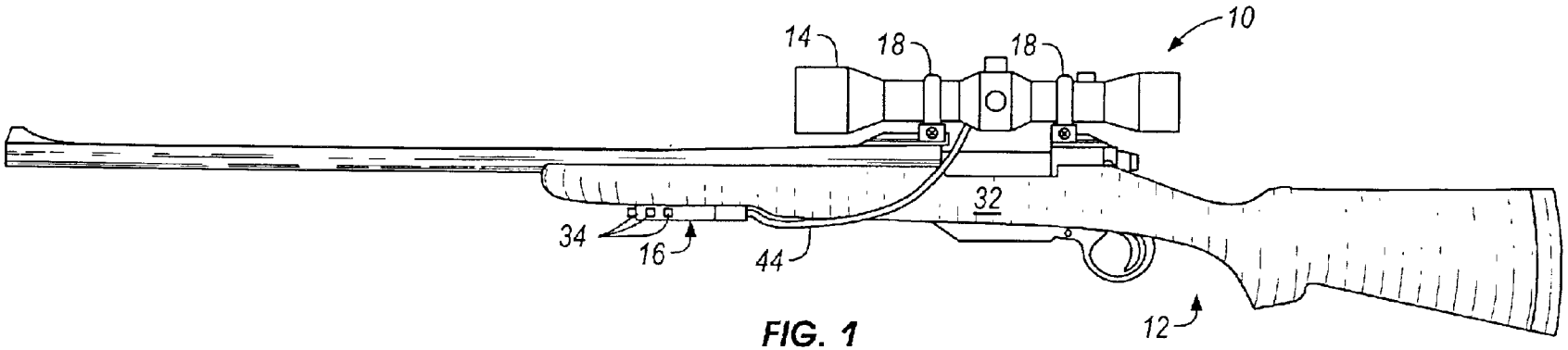
FIG. 1 is a side-view of one embodiment of the modular scope of the present invention mounted to a rifle.

FIG. 1 depicts a side-view of a modular scope 10 according to the present invention mounted on a rifle 12. While scope 10 is depicted as being mounted on a rifle, the modular scope may also be used for photography or other activities that require viewing from a distance. In a first embodiment, scope 10 includes a body module 14 and a control module 16.

Body module 14 may be provided with fixed-magnification (fixed power), variable-magnification (variable power) or general viewing and image recording capabilities. Moreover, the body module typically includes the mechanisms required to make adjustments to the scope. Typically, these adjustments are made through the use of small electronic adjustment motors that power movement of internal parts. In addition to adjusting windage and elevation settings, the body module may include motors that aid in the adjustment of magnification and focus. The adjustment motors may be ultrasonic, linear or other type. The motors may include gear sets to drive the internal parts.

The method of attaching the body module to the rifle may be the same as conventional scope designs, such as rings that encircle the body module and connect to the rifle. As shown, scope 10 is mounted to the top of rifle 12 with the use of mounting hardware 18. Alternatively, or additionally, it may be desirable for the body module to have a socket for camera-like mounting on a tripod.

Figure 2:
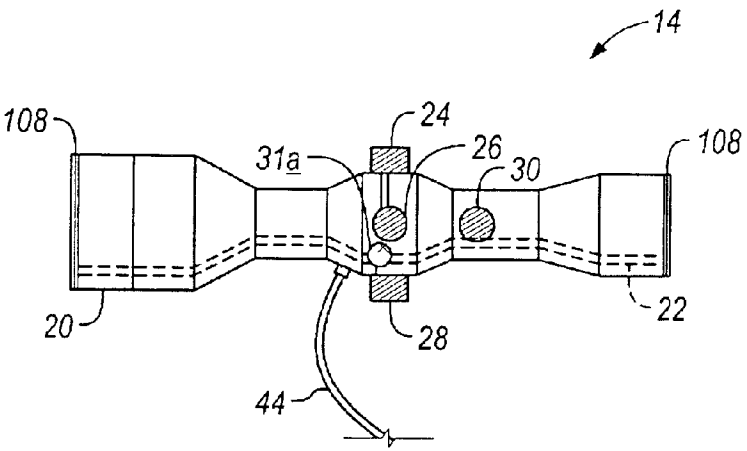
FIG. 2 is a plan view of the modular scope shown in FIG. 1.

FIG. 2 is a plan view of one embodiment of a body module 14. The body module generally includes a completely sealed external casing 20. Housed within the casing may be control wires 22, which run the length of the scope body. These control wires may further provide for attachment of modular units to both ends of the body module. These wires may provide a data bus capability.

The body module depicted in FIG. 2 includes a windage adjustment motor 24, an elevation adjustment motor 26, a focus adjustment motor 28 and a magnification adjustment motor 30. Each of the adjustment motors may be in electronic communication with a control module (not shown) so that the user can make adjustments to the scope settings via the control module.

Typically, though not necessarily, reticle (cross hair) configurations and display features are included in the body module along with reticle brightness circuitry (lamps, light emitting diodes and wiring). It is contemplated that if these or any other features are not originally included with the body module, the body module may be configured such that the optional features may be activated by the addition of supplementary modules, switch settings and/or control module software.

The above embodiment may be modified to allow for addition of relatively complex features, such as range finding, by providing for the attachment of an eyepiece module; display of more information by the objective module; and/or upgrading of the control module by addition of submodules, internal switch setting changes, or software changes.

Optionally, at the time of manufacture, the serial number for the body module and its date of manufacture may be stored in a read only memory chip 31*a* that is housed within the body module. The serial number and date of manufacture can be used to track the scope and determine what features are included with the scope as well as to determine compatibility with new or additional modules and/or upgrades.

Returning to FIG. 1, as stated above, the present invention also provides a control module 16. As shown, control module 16 may be mounted to the underside of rifle stock 32. Typically, control module 16 is placed on the rifle within easy reaching distance for the user such that the user can activate the user inputs without needing to alter his or her shooting position. The control module is typically ergonomically designed so that it can be comfortably held by the user while scanning for a target, shooting, or adjusting the settings and displays.

Control module 16 may be mounted to the rifle, camera tripod, or other platform or device using any suitable means including, but not limited to screws and hook and loop fasteners such as those sold under the Velcro® trademark. Alternatively, the control module may be housed within the rifle stock.

In some embodiments, a sealed, shock resistant, removable connection for one or both ends of the connecting harness allows for easy repair and replacement of the body module and the other modules. As above, at the time of manufacture, the serial number for the control module and its date of manufacture are stored in a read only memory chip that is in the control module.

Control module 16 includes a plurality of user inputs or switches 34. Inputs 34 provide for the transmission of information between the user and the body module. For example, at least one of the inputs may allow the user to make adjustments to the body module. Alternatively, or additionally, the inputs may be used to control internal or external displays and/or activate or deactivate various features.

The user inputs generally allow the user to control the adjustment motors, displays and other features of the scope. Typically, the user inputs are located so as to allow the user to activate the inputs without having to disengage from the shooting position. To this end, the switches are typically controlled by finger movements of the user.

Figure 3:
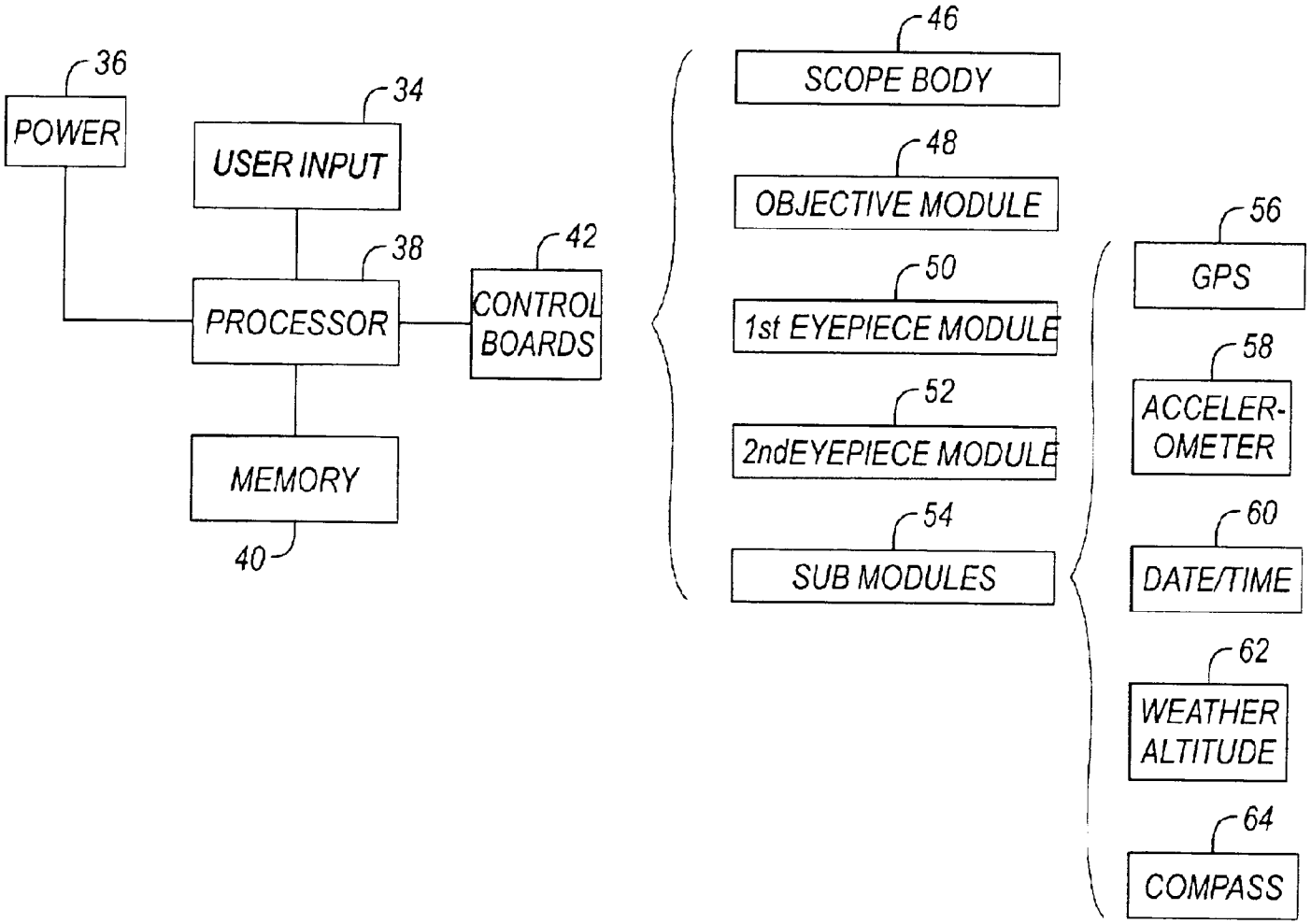
FIG. 3 is a schematic diagram of an example of a control module according to the present invention.

FIG. 3 is a schematic diagram depicting one possible embodiment of control module 16. Control module 16 includes a power supply 36 and a processor 38. Processor 38 is linked to memory 40, user inputs 34 and one or more control boards 42.

In order to provide for the transmission of information, processor 38 is typically in electronic communication with all other modules in the scope. This communication may be achieved, for example 3 through the use of wires contained in an environmentally sealed harness 44 (as shown in FIGS. 1 and 2 ). In addition, the control module may include one or more memory storage devices, batteries, battery indicators, software, and ports for attachment of additional modules, such as the test module described in further detail below.

Processor 38 may be further adapted to provide one or more of any of the following features: automatic turn on, for example, when any switch is touched or activated; automatic turn off, for example, after a given period of non-use; global positioning system (GPS) circuitry to provide latitude and longitude; electronics for altitude, compass heading, temperature, date and time; battery status indicator, such as determination of time remaining; periodic self-testing of modules, display of warning, and error logging; night vision capabilities; electronic magnification; range finding; and/or wired and wireless transmission of image and data to remote equipment such as digital cameras and video recorders. Moreover, processor 38 may be configured such that product use information such as dates of use, shooting location, and acceleration/recoil can be developed and stored in memory 40.

Control boards 42 may include a body module control board 46, an objective module control board 48, a first eyepiece module control board 50, a second eyepiece module control board 52 (if desired), and any other desired submodules 54 including a global positioning system (GPS) submodule 56, an accelerometer submodule 58, a date/time submodule 60, a weather/altitude submodule 62, and/or a compass submodule 64.

When a user presses, selects, or otherwise activates a particular user input, processor 38 interprets the user's desired action and directs an appropriate signal to the corresponding control board, which in turn is able to direct an appropriate signal to the appropriate controlled feature of the scope.

For example, should a user desire to make an alteration to the windage setting, the user may activate the appropriate user input by depressing a button, toggling a switch, turning a knob, or the like, thus sending a signal to the body module control board 46 via processor 38. As shown, the body module control board may be in electronic communication with one or more adjustment motors in the body module, such as windage adjustment motor 24. Thus, the appropriate electric signal is sent to the windage adjustment motor, which then may make the appropriate alteration to the windage setting.

Figure 4:
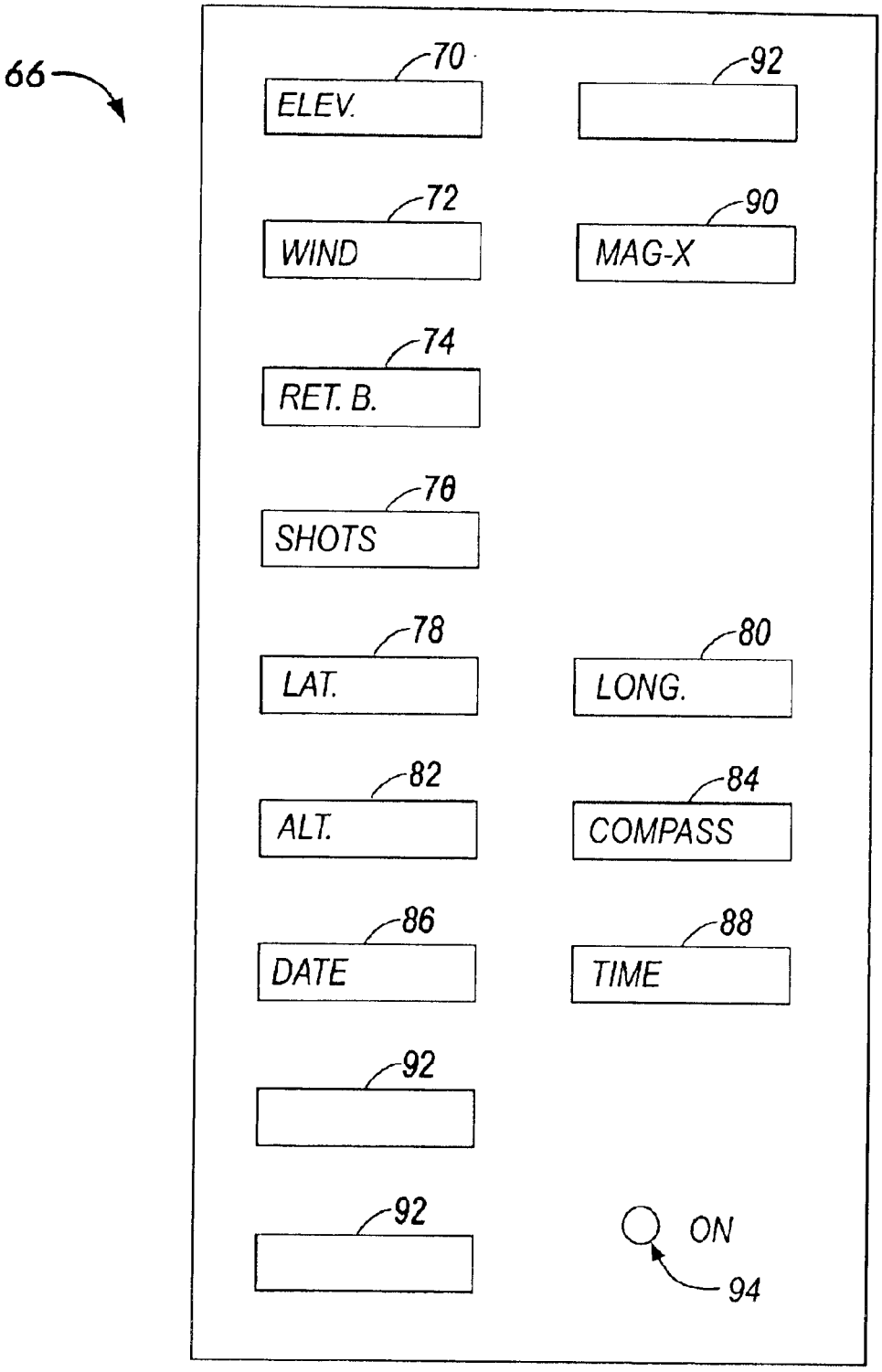
FIG. 4 is an exemplary display panel suitable for use with the control module of the present invention.

FIG. 4 depicts an exemplary display panel 66 for control module 16. As shown, the display panel may include a variety of indicators 68, including an elevation indicator 70, a wind indicator 72, a reticle brightness indicator 74, a shots fired indicator 76, a latitude indicator 78, a longitude indicator 80, an altitude indicator 82, a compass indicator 84, a date indicator 86, a time indicator 88, a magnification indicator 90, and any additional indicators 92 as desired. For example, the display panel may include a "time remaining" display to indicate the remaining battery life. Typically, display panel 66 will further include a power on/off indicator 94. As will be appreciated, the location and appearance of the indicators shown in FIG. 4 is meant to be exemplary and non-limiting, additional configurations are contemplated and considered to be within the scope of the present invention.

As a non-limiting example, the control module may be configured to check for installed modules and submodules and/or perform startup of displays on control module 16 and any other modules, if applicable. Moreover, control module 16 may be configured to zero the accelerometer reading; read and store any serial numbers associated with installed modules or submodules; and/or start up individual submodules located within the control module and verify their correct operation.

Upon firing of the rifle, which may be determined, for example, when the control module detects that recoil exceeds a pre-specified acceleration such as 100 g's, the control module may be configured to read submodule information including: latitude and longitude as determined by the GPS submodule; accelerometer setting; date and time; weather conditions data; and compass heading. The control module may be further configured to detect and store the number of shots fired and reset the accelerometer setting.

Any or all of these readings maybe may be transferred to memory 40 for long-term storage. This stored data may then be used to provide up-to-date values to front panel and objective module displays, if applicable.

Figure 5:
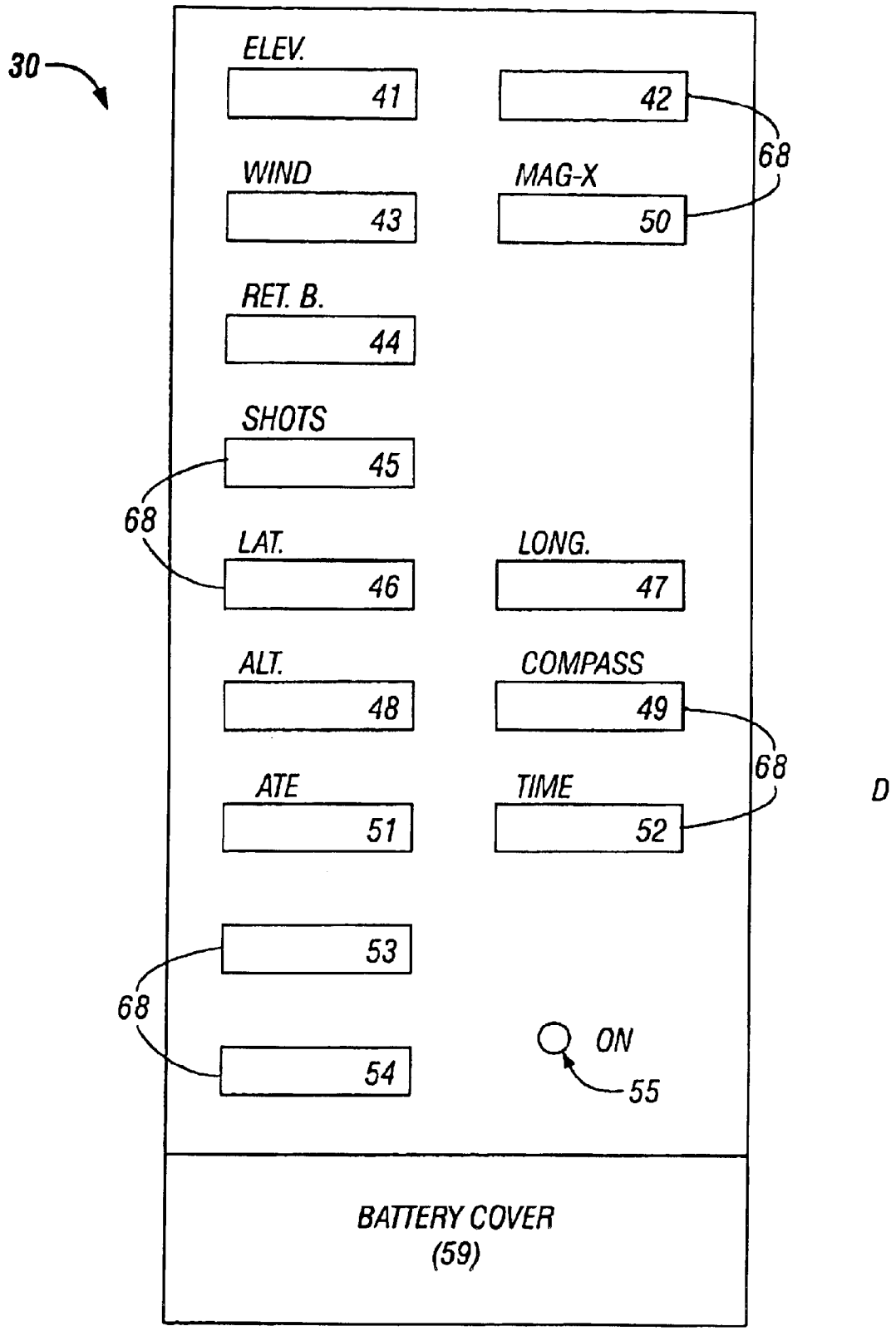
FIG. 5 is a plan view of another embodiment of the modular scope of the present invention.

FIG. 5 depicts an embodiment of the present invention including modules in addition to the body and control modules. These modules may include a body module 14, an objective or display module 96, a first sunshade or filter module 98, an eyepiece module 100 and a second filter module 102. Scope 10 may be connected to control module 16 via connecting harness 44 and control module 16 may be, in turn, connected to a test module 104 via a connecting harness 106.

Objective module 96 is primarily intended for the display of various data and settings that are important to the user. Because the objective module is separate from the body module, it is contemplated that the body module will be compatible with multiple objective modules, thus allowing the user to select the particular objective module that best suits the needs of the user. Moreover, as new objective modules are made available, the user can replace the older objective module with the newer one without having to replace the body module or other components of the modular scope.

The objective module is typically designed so that it can be securely attached to the body module through the use of twist lock bayonet or screw fittings 108 (as shown in FIG. 2). When properly attached, control wires for adjustment motors and other features in the body module may be electrically connected to the control module via connecting harness 44, either directly, or through the objective module. Moreover, individual displays and features/options in the objective module, and features/options in the eyepiece module(s), may be connected to the control module via the connecting harness. In addition, the objective module may further allow for the attachment of sunshades and/or filters 98.

As with the body module described above, the serial number for the objective module and its date of manufacture may be stored in a read only memory chip 31*b* that is in the objective module. The features and capabilities of the objective module may include, but are not limited to: display of various user settings; display of fixed information such as serial numbers and dates of manufacture; and display of variable information such as latitude, longitude, altitude, compass direction, date, time, distance to target, number of shots fired, and acceleration of last shot.

Figure 6:
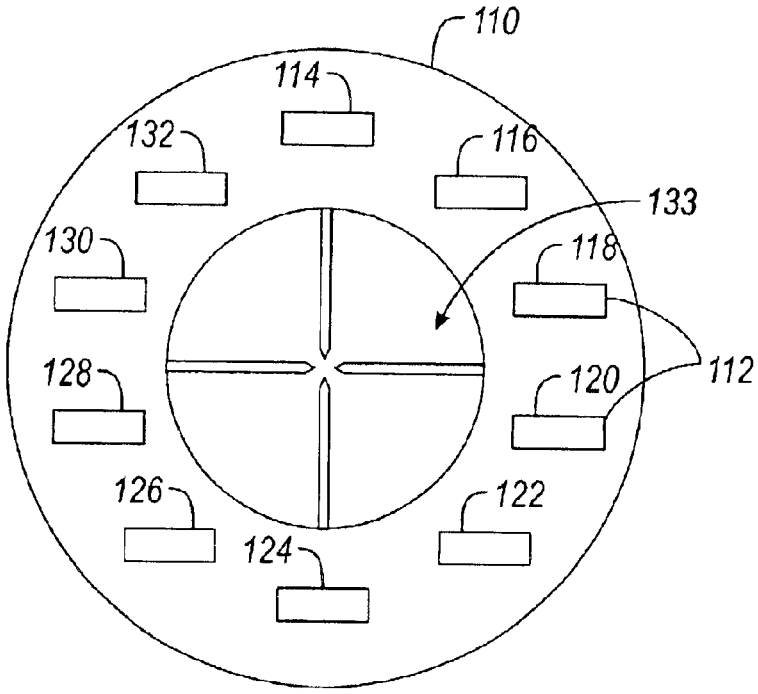
FIG. 6 is an exemplary data display as could be seen through an objective module according to the present invention.

FIG. 6 depicts an exemplary data display 110 as seen through objective module 96. As shown, the data display may include a plurality of indicators 112 including an elevation indicator 114, a range indicator 116, a windage indicator 118, a reticle brightness indicator 120, a shots fired indicator 122, a latitude indicator 124, a longitude indicator 126, an altitude indicator 128, a compass indicator 130 and a power/magnification indicator 132. Typically, these indicators are arranged around the cross hairs display 133 so as not to distract the user or obstruct the user's view of the target. However, as will be appreciated, the location and appearance of the indicators shown in FIG. 6 is meant to be exemplary and non-limiting and any other suitable arrangement is contemplated by the present invention.

Returning to FIG. 5, the present invention also provides for an eyepiece module 100. Eyepiece module 100 attaches to the body module and provide users with features, options and capabilities whenever they are needed. As with the objective module, the eyepiece module may be sold with the body module and the other modules, but may also be sold or updated independently from the body module. The eyepiece module may be designed so that, when properly attached to the body module, its control wires and displays are electrically linked to the control module via a connecting harness, either directly, through the body module, or through the objective module.

As above, at the time of manufacture, the serial number for the eyepiece module and its date of manufacture may be stored in a read only memory chip 31*c* that is in the eyepiece module. The eyepiece module may include night vision, electronic magnification, range finding, and capture of images capabilities. The eyepiece may be designed to allow for attachment of filters 102. The eyepieces and body module are designed such that multiple different eyepieces may be interchangeably attached to a single body module.

As stated above, the present invention may include a test module 104. The test module may be used by the user, manufacturer, retail stores, or others. The test module may plug directly into a port on the exterior of the control module. The test module may have one or more pre-programmed test sequences that can be run for each scope model, or for specific modules and module combinations. During the tests, all of the electrically controlled scope adjustments may be run through their full range of settings, and are then returned to the original (user's) settings. In one embodiment, the person doing the testing may look through the scope to verify proper operation of the adjustment motors (in the body module), individual displays, and other features/options/capabilities.

Alternatively, the test module may link directly to an external computer. The external computer may include a library of test sequences that can be run for each scope model, or for specific modules and module combinations. It is contemplated that these tests may be made available to purchasers of test modules through external data storage devices such as floppy disks or CD-ROMs.

The test module may also perform tests on the control module, check the batteries, and verify correct functioning of the switches, the battery indicators, and other features. The test module may recharge the batteries in the control module, if necessary. The test module may connect to a printer for a hard copy printout that can be given to the owner of the scope. The test module may save test information by body module and module serial number(s), and retrieve product use information from control module memory chips. Data from product tests, and product use information, may be transmitted, as needed, from the test module to the product manufacturer for later analysis.

Figure 7:
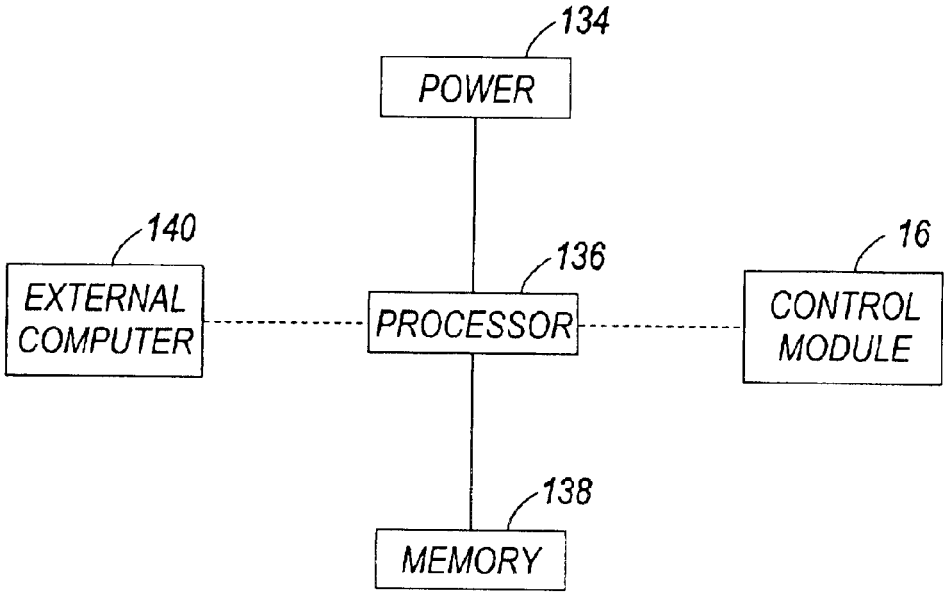
FIG. 7 is a schematic diagram depicting one embodiment of a test module according to the present invention.

FIG. 7 is a schematic diagram of depicting one embodiment of test module 104. As shown, test module 104 includes a power supply 134 connected to a processor 136. Processor 136 is linked to memory 138. In addition, processor 136 may be linked to control module 16, for example via connecting harness 106, as shown in FIG. 2. Moreover, processor 136 may be linked to an external computer 140, in order to engage in various testing procedures, as described above.

Returning to FIG. 5, because user access is not needed for adjustments, it can be seen that the various independent modules may be sealed inside removable covers. For example, cover 142 may enclose objective/display module 96 with the front part of body module 14. Cover 144 may enclose eyepiece module 100 with the rear part of body module 14. A central cover 146 may enclose the remainder, i.e. center portion, of body module 14. These covers may be made from any suitable material, including waterproof fabric.

As will be appreciated, these covers may be provided in a variety of colors and patterns to allow the user to select the cover design that best fits the user's particular need. For example, different locations may require different designs to obtain the best degree of camouflage. Specifically, a cover having a green camouflage pattern may work better for someone using the scope in a forest or jungle than for someone using the scope in a desert.

As will be further appreciated, the scope of the present invention may include additional modules or capabilities. For example, the scope may be adapted to be used as an event recorder. Specifically, some users may desire the scope to be capable of recording an image of a shooting target at or near the moment of impact. This may be implemented by adapting the recording function in the scope to record one or more images when the gun's recoil exceeds a pre-specified acceleration such as 100 g's.

The present invention provides a scope having a modular design, thus allowing the scope to be upgraded to add new and/or additional modifications to the basic scope. The present invention provides a series of modular units that can be used to provide the user with a single scope that can be used in a variety of situations and that can be easily upgraded when new features become available.

In one embodiment, the present invention provides a series of at least five modular components that can be combined in a variety of configurations to form a scope. The modules are designed such that any of the modular units may be combined with any or all of the other modular units. These modular components include a completely sealed body module, an objective module, an eyepiece module, a control module, and a test module.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. For example, while the invention has been described primarily for use as a scope for use with a rifle, the invention is also suitable for image recording at a distance uses such as photography and bird watching and therefore, the device to which the scope is attached may take the form of a firearm, a camera, surveying instruments, binoculars, and the like. These uses may or may not require specific or different configurations of the modular modules, for example, windage and elevation setting adjustments may not be necessary. Furthermore, the body module may be mounted to a camera-type tripod or other platform or device rather than to the stock of a rifle. Such modifications are contemplated by the present invention.

The subject matter of the inventions includes all novel and non-obvious combinations and subcombinations of the various elements, features, functions and/or properties disclosed herein. Similarly, where the disclosure recites "a" or "a first" element or the equivalent thereof, such claims should be understood to include incorporation of one or more such elements, neither requiring nor excluding two or more such elements.

What is claimed is:

1. A viewing scope adapted to be mounted on a device, the viewing scope comprising:

a body module including a plurality of adjustment motors adapted to adjust the scope's magnification, focus, windage and elevation;

an objective module adapted to provide a visual display;

a test module configured to run at least one pre-programmed test sequence; and a control module in electronic communication with the body module, test module, and objective module, the control module being mounted on the device, the control module including a series of user inputs that can be accessed and activated by a user without requiring the user to move his or her visual focus from the scope, the inputs being in electronic communication with the plurality of adjustment motors.

2. The scope of claim 1 where at least one of the body module, objective module, test module, and control module includes a serial number stored in a read only memory chip.

3. The scope of claim 2 where the control module is configured to read and store the serial number.

4. The scope of claim 3 where the pre-programmed test sequence run by the test module is determined by the serial number.

5. The scope of claim 1 where the test module is configured to be plugged directly into the control module.

6. The scope of claim 1 where the test module is configured to be linked to an external computer.

7. The scope of claim 1 where the objective module, test module and control module are each modular units adapted to be replaced and/or, upgraded as desired without requiring removal of the body module from the device.

8. The scope of claim 7 where the control module is configured to detect the presence and specifications of any modular units attached to the body module.

9. The scope of claim 8 where the control module is configured to adjust the pre-programmed test sequence performed by the test unit based on the specifications of the modular units detected by the control module.

10. The scope of claim 1 further including one or more removable covers enclosing at least a portion of one or more of the body module, objective module, test module and control module.

11. The scope of claim 1 further comprising an eyepiece module in electronic communication with the control module.

12. The scope of claim 11 where a removable cover encloses at least a portion of the eyepiece module.

* * * * *

UNITED STATES PATENT AND TRADEMARK OFFICE

CERTIFICATE OF CORRECTION

PATENT NO. : 6,813,025 B2
DATED : November 2, 2004
INVENTOR(S) : Edwards

It is certified that error appears in the above-identified patent and that said Letters Patent is hereby corrected as shown below:

The title page, showing the illustrative figure, should be deleted to be replaced with the attached title page.

Drawings,
Sheets 4 and 5, should be deleted to be replaced with drawing sheets, consisting of Figs. 4 and 5, as shown on the attached page.

Signed and Sealed this

Thirteenth Day of June, 2006

JON W. DUDAS
*Director of the United States Patent and Trademark Office*

(12) United States Patent
Edwards

(10) Patent No.: US 6,813,025 B2
(45) Date of Patent: Nov. 2, 2004

(54) MODULAR SCOPE

(76) Inventor: Ralph C. Edwards, 3124 NE. 16th Ave., Portland, OR (US) 97212

( * ) Notice: Subject to any disclaimer, the term of this patent is extended or adjusted under 35 U.S.C. 154(b) by 0 days.

(21) Appl. No.: 10/155,802

(22) Filed: May 24, 2002

(65) Prior Publication Data

US 2002/0191282 A1 Dec. 19, 2002

Related U.S. Application Data

(60) Provisional application No. 60/299,549, filed on Jun. 19, 2001.

(51) Int. Cl.[7] ..... G02B 23/00; F41G 1/38

(52) U.S. Cl. ..... 356/422; 359/399; 42/122

(58) Field of Search ..... 359/399–430, 359/800–819; 42/100–132; 396/429–433

(56) References Cited

U.S. PATENT DOCUMENTS 3,506,330 A * 4/1970 Allen ..... 356/397
3,709,124 A * 1/1973 Hunt ..... 396/426
4,777,352 A * 10/1988 Moore ..... 235/404
5,400,267 A 3/1995 Denen et al. ..... 364/552
5,661,598 A * 8/1997 Tomioka ..... 359/388
5,669,174 A * 9/1997 Teetzel ..... 42/115
5,673,143 A 9/1997 Chin et al. ..... 359/354
6,020,996 A 2/2000 Perkins et al. ..... 359/399
6,192,614 B1 2/2001 Cliburn ..... 42/106
6,208,461 B1 3/2001 Gaber ..... 359/399
6,269,581 B1 * 8/2001 Groh ..... 42/122
6,519,083 B2 * 2/2003 Heinrich ..... 359/422

* cited by examiner

*Primary Examiner*—Thong Q Nguyen
(74) *Attorney, Agent, or Firm*—Kolisch Hartwell, P.C.

(57) ABSTRACT

The present invention provides a viewing scope adapted to be mounted on a device, such as a rifle or camera. The viewing scope may include a body module, an objective module, a test module, and a control module. The test module may be configured to test the performance of the scope. The control module may include a series of user inputs that can be accessed and activated by a user without requiring the user to move his or her visual focus from the scope.

12 Claims, 5 Drawing Sheets

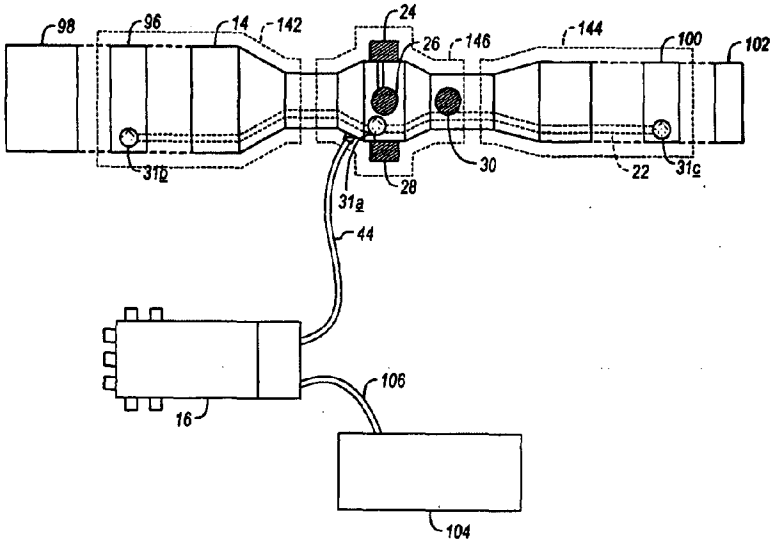

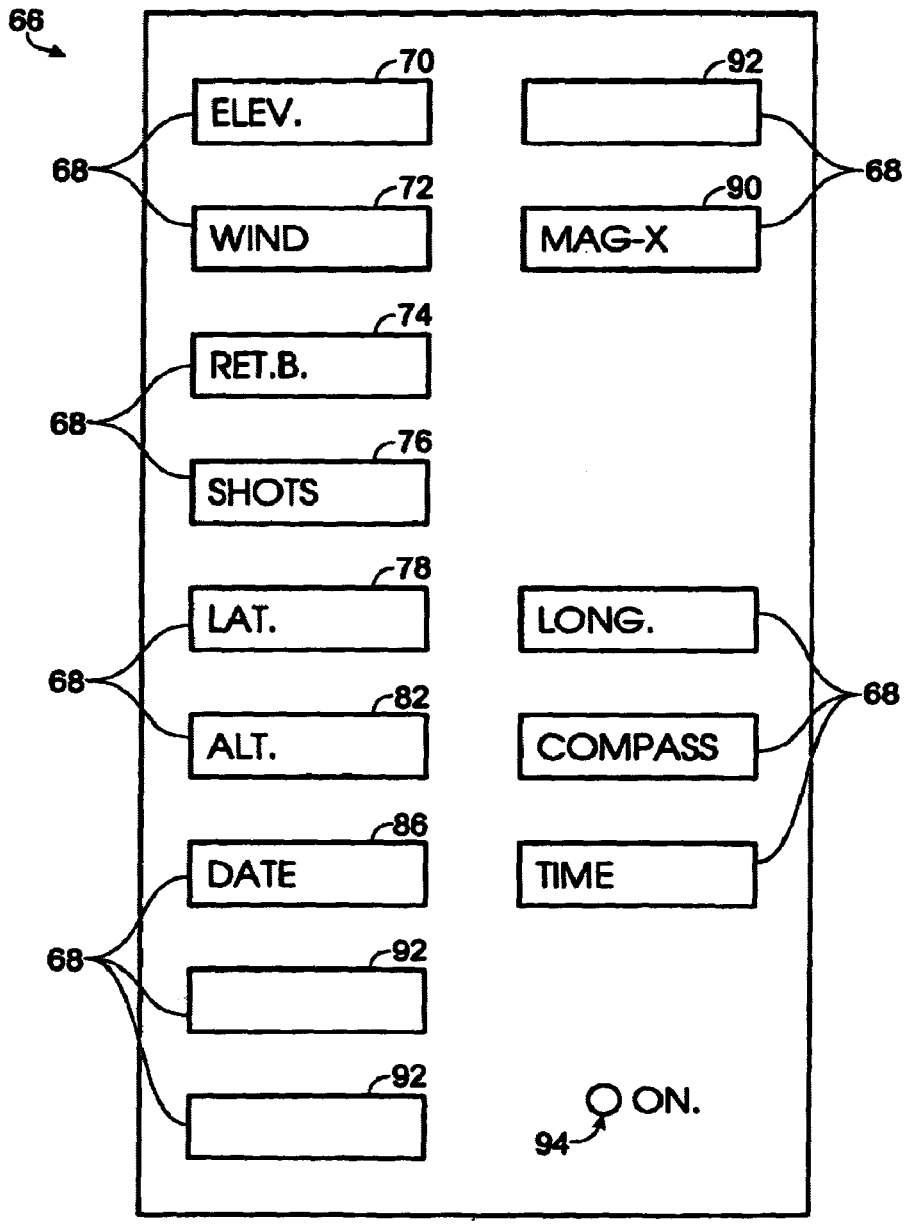
66
70
ELEV.
92
68
72
WIND
90
MAG-X
68
74
RET.B.
68
76
SHOTS
78
LAT.
LONG.
68
82
ALT.
COMPASS
68
86
DATE
TIME
68
92
92
ON.
94

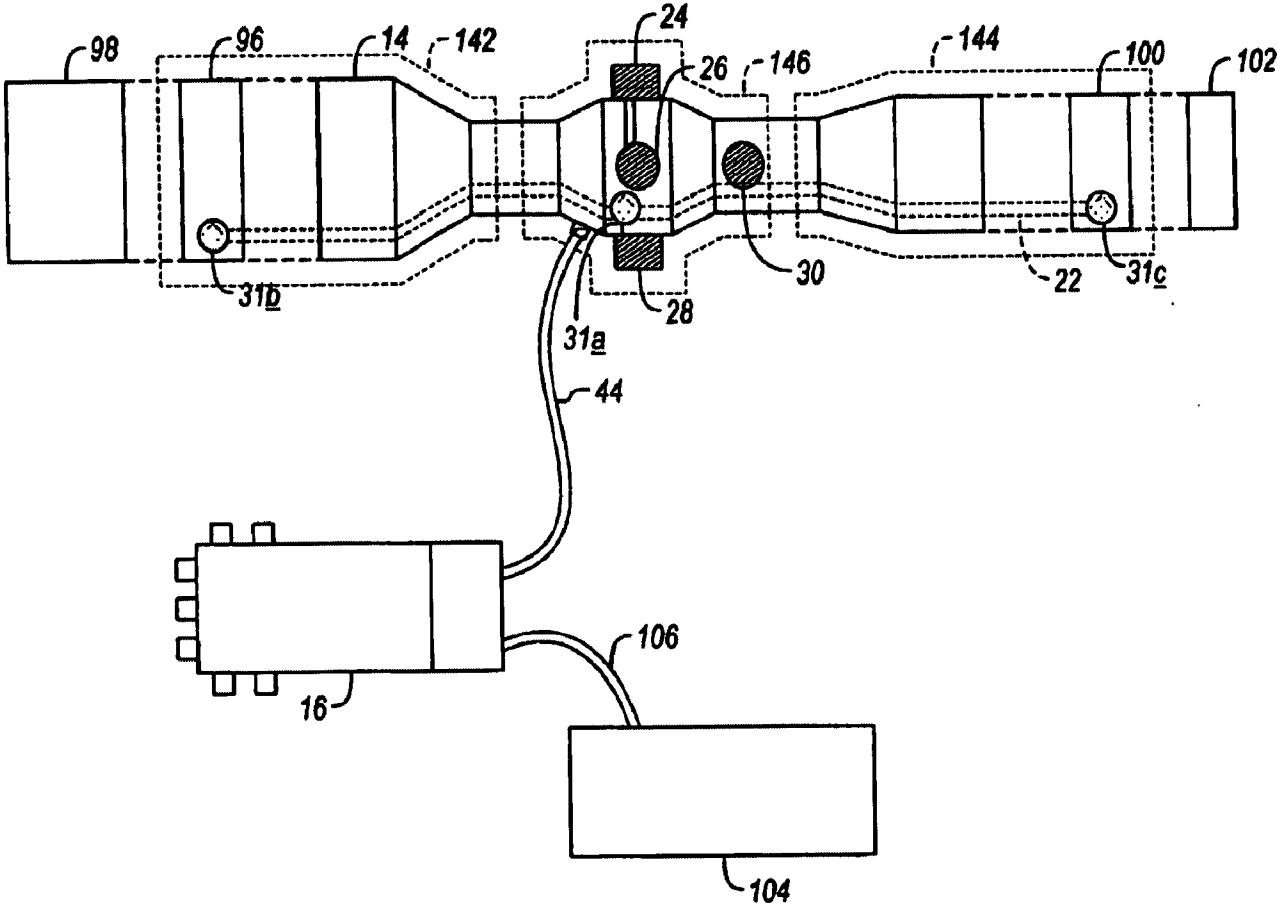
102
100
31c
22
144
146
30
26
24
28
31a
44
142
14
96
31b
98
106
104
16